US005103922A

United States Patent [19]

Jones

[11] Patent Number: 5,103,922

[45] Date of Patent: Apr. 14, 1992

[54] FISHTAIL EXPENDABLE DIAMOND DRAG BIT

[75] Inventor: Kenneth W. Jones, Kingwood, Tex.

[73] Assignee: Smith International, Inc., Houston, Tex.

[21] Appl. No.: 606,001

[22] Filed: Oct. 30, 1990

[51] Int. Cl.[5] ..... E21B 10/42

[52] U.S. Cl. ..... 175/429; 175/421

[58] Field of Search ..... 175/329, 379, 393, 409, 175/411, 412, 413, 421

[56] References Cited

U.S. PATENT DOCUMENTS

| | | | |
|---|---|---|---|
| 1,923,488 | 8/1933 | Howard et al. . | |
| 2,580,860 | 1/1952 | Stokes | 175/421 X |
| 3,140,748 | 7/1964 | Engle et al. . | |
| 3,145,790 | 8/1964 | Bridwell et al. . | |
| 3,180,440 | 4/1965 | Birdwell | 175/411 X |
| 3,938,599 | 2/1976 | Horn | 175/329 |
| 4,221,270 | 9/1980 | Vezirian | 175/329 |
| 4,234,048 | 11/1980 | Rowley | 175/329 |
| 4,246,977 | 1/1981 | Allen | 175/329 |
| 4,253,533 | 3/1981 | Baker, III | 175/329 |
| 4,265,324 | 5/1981 | Morris et al. | 175/329 |
| 4,303,136 | 12/1981 | Ball | 175/329 |
| 4,325,439 | 4/1982 | Vezirian | 175/329 |
| 4,334,585 | 6/1982 | Upton | 175/329 |
| 4,350,215 | 9/1982 | Radtke | 175/329 |
| 4,440,247 | 4/1984 | Sartor | 175/393 |
| 4,475,606 | 10/1984 | Crow | 175/410 |
| 4,494,618 | 1/1985 | Radtke | 175/393 |
| 4,499,958 | 2/1985 | Radtke et al. | 175/329 |
| 4,505,342 | 3/1985 | Barr et al. | 175/329 |
| 4,533,004 | 8/1985 | Ecer | 175/329 |
| 4,538,690 | 9/1985 | Short, Jr. | 175/329 |
| 4,538,691 | 9/1985 | Dennis | 175/393 |
| 4,539,018 | 9/1985 | Whanger et al. | 51/295 |
| 4,646,857 | 3/1987 | Thompson | 175/329 |
| 4,710,074 | 12/1987 | Springer | 408/200 |
| 4,719,979 | 1/1988 | Jones | 175/329 |
| 4,813,500 | 3/1989 | Jones | 175/329 |
| 4,830,123 | 5/1989 | Daly et al. | 175/329 |

FOREIGN PATENT DOCUMENTS

| | | |
|---|---|---|
| 0121802 | 10/1984 | European Pat. Off. . |
| 468987 | 7/1975 | U.S.S.R. . |

*Primary Examiner*—William P. Neuder
*Attorney, Agent, or Firm*—Robert G. Upton

[57] ABSTRACT

A fishtail type drag bit is disclosed consisting of multiple blades, each blade forming radially disposed grooves. Each groove contains equidistantly spaced diamond cutters along its length. The cutters are additionally oriented at a negative rake angle with respect to a borehole bottom. The vertical alignment of the diamond cutters paralleling an axis of the bit are staggered to destroy kerfs which remain in the formation from preceding eroded rows of diamond cutters as the bit works in the borehole.

13 Claims, 3 Drawing Sheets

FISHTAIL EXPENDABLE DIAMOND DRAG BIT

CROSS-REFERENCE TO RELATED APPLICATION

This application is related to a patent application entitled Expendable Diamond Drag Bit, U.S. Ser. No. 109,980 filed Oct. 19, 1987, now U.S. Pat. No. 4,813,500 issued Mar. 21, 1989.

BACKGROUND OF THE INVENTION

1. Field of the Invention

The present invention is directed to drag bits having diamond or other hard cutter elements. More particularly, the present invention is directed to blade-type drag bits incorporating multiple diamond disc cutters. As the blades erode during drilling in a formation, new diamond elements are continuously exposed for attacking the formation.

2. Brief Description of the Prior Art

Drill bits or rock bits are well known in the art. Such drill bits are used for drilling in subterranean formations when prospecting for oil, water or minerals. The term "drag bit", generally speaking, designates a drill bit which has no rotating cones and which is rotated either from the surface through a string of drill pipes and drill collars (drill string) or by a suitable "downhole" motor. In contrast, rotary cone bits have one or more journals each of which carry a freely rotatable drill bit cone. Regardless of whether rotary cone bits or drag bits are used for drilling in a formation, drilling fluid or "drilling mud" is continuously circulated from the surface through the drill string down to the drill bit, and up to the surface again. As is well known, the circulating mud serves several important functions; these include continuous cooling of the drill bit and removal of the downhole cuttings which are generated by the drilling action.

Several types of drag bits are known in the art; these include fishtail bits, auger bits, as well as more "conventional" drag bits which lack relatively large extending blades but nevertheless may be provided with "hard" diamond, tungsten-carbide, or the like cutter inserts. Blade-type rotary drag bits are also known in the art which have diamond or other "hard" cutter inserts imbedded or affixed to the blades. Such blade-type bits are described, for example, in U.S. Pat. Nos. 4,440,247, 4,499,958 and the aforementioned U.S. Pat. No. 4,813,500.

Generally speaking, one serious problem encountered in the prior art in connection with diamond insert studded drag bits is overheating of the diamond inserts due to inadequate flushing and cooling action of the drilling fluid. As is known, heat, unless dissipated through adequate cooling with drilling fluid, may convert the diamond of the inserts into graphite with a resulting loss of hardness and drilling power. Thereby allowing the inserts to rapidly wear away.

The prior art has attempted to solve the foregoing problems by providing drilling fluid outlet passages or holes adjacent to the diamond inserts in the drag bits, and by appropriately choosing the configuration of the drag bit body so as to optimize the flushing and cooling action of the drilling fluid on the cutter inserts. The drill bits described in U.S. Pat. Nos. 4,221,270, 4,234,048, 4,246,977, 4,253,533, 4,303,136, 4,325,439, 4,334,585, 4,505,342, and 4,533,004 provide examples of these efforts in the prior art.

Still further description of drill bits, which comprise a general background to the present invention, may be found in U.S. Pat. Nos. 3,938,599, 4,265,324, 4,350,215, 4,475,606, 4,494,618, 4,538,690, 4,538,691, and 4,539,018. A general overview of "Rock-Bit Design, Selection, and Evaluation" may be found in a paper bearing the above title. This paper is a revised reprint of a presentation made by H. G. Bentson at the Spring meeting of the Pacific Coast District, API Division of Production, Los Angeles, May, 1956, printed in August, 1966.

A problem associated with fishtail type bits is to maximize the cutting efficiencies of each blade of the bit. Generally speaking, conventional blade bits provide a blade leading edge angle of attack relative to the bottom of a borehole that is perpendicular to the bottom of the borehole.

The present invention teaches rows of strategically positioned tungsten carbide backed diamond discs mounted to the cutting face of a blade, each cutting disc having a negative angle of attack with respect to the borehole bottom, affording heel clearance, thereby generating less heat, because of the preferential wear of the softer tungsten carbide in relation to the diamond table, therefore greatly extending the wear life of the diamond disc cutters.

In summary, the foregoing patent disclosures provide evidence of intense efforts in the prior art to develop rock bits in general, and diamond cutter insert studded drag bits in particular, which have prolonged working lives and improved wear characteristics. In spite of the foregoing efforts, there is definitely need for improvement in this field. Specifically, there is a need in the art for blade-type drag bits having diamond cutter elements retained on the blade with negative cutter element attack angles with respect to a borehole bottom and for said cutters to be positioned in radial rows with each row leaving kerfs of formation to be destroyed by each succeeding row of cutters axially positioned to completely over-lap these uncut kerfs thereby greatly increasing the drilling rates because by definition Poisson's ratio show the shear strength of the unsupported kerfs cannot be greater than 50% of the compressive strength of the totally supported virgin rock.

SUMMARY OF THE INVENTION

It is an object of the present invention to provide a blade-type drag bit which has improved operating life and wear characteristics.

It is another object of the present invention to provide a blade-type bit having multiple diamond cutter discs which are retained in the blades; new rows of discs are exposed for operative engagement with the formation to be drilled, even as the blade wears or erodes during drilling.

It is still another object of the present invention to provide a blade-type drag bit having diamond cutter elements wherein each cutter element is positioned on the blade with a negative rake angle with respect to a borehole bottom to maximize bit penetration during operation in a borehole.

The foregoing objects or advantages are attained by a blade-type drill bit which has a pin end adapted to be removable attached to a drill string, and a bit body extending from the pin end. The bit body has an interior cavity in fluid communication with the drill string to receive a supply of drilling fluid contained within the drill string. At least one drill blade is attached to the bit body. The blade has a leading edge configured to contact the formation during drilling. A plurality of conduits or apertures are in fluid communication with the interior cavity of the bit body and direct fluid through the conduit and out of nozzles attached at an exit end of the conduit.

Each blade, on its forward cutting surface, has a plurality of equidistantly spaced, radially disposed grooves formed therein. Each groove is formed with identical negative rake angles.

A multiplicity of diamond discs are metallurgically bonded to and equidistantly spaced in each of the radially disposed grooves, the equidistantly spaced diamond discs in adjacent rows are longitudinally staggered so as to destroy kerfs remaining in the formation from preceding eroded rows as the bit works in a borehole.

The foregoing and other objects and advantages can be best understood, together with further objects and advantages, from the ensuing description taken together with the appended drawings wherein like numerals indicate like parts.

DESCRIPTION OF THE PREFERRED EMBODIMENTS AND BEST MODE FOR CARRYING OUT THE INVENTION

Figure 1:
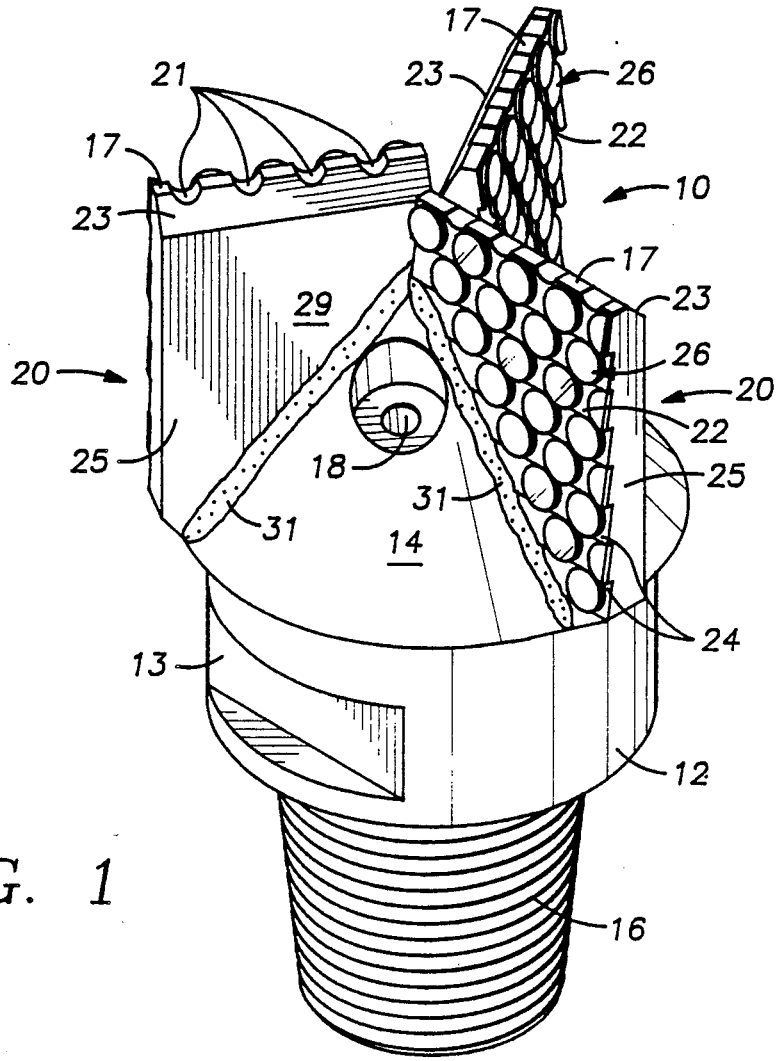
FIG. 1 is a perspective view of a first preferred embodiment of the blade-type drilling bit of the present invention.

FIG. 1 is a perspective view of a preferred embodiment of fishtail type diamond drag bit, generally designated as 10. The fishtail bit is comprised of a bit body 12, a dome portion 14 and a pin end 16. Tool slots 13 are formed in the body 12 to facilitate removal of the bit from an end of a drill string (not shown). A plenum chamber or cavity 15 is formed with the bit body 12. The dome portion 14 confines one end of the chamber, the opposite end of the chamber communicates with an opening in the pin end 16 of the bit body 12. Nozzles 18 are threaded into conduit 11 and communicate with chamber 15 formed within the body 12 (see FIG. 2).

The cutter blades generally designated as 20, for example, are welded to the dome portion 14 to form the cutting end 17 of the bit 10. Each of the cutting blades 20 forms a cutting face 22. The cutting face 22 forms a plurality of equidistantly spaced radially disposed grooves 24. Each groove 24 is milled with a negative rake angle with respect to a substantially perpendicular borehole bottom formed in a formation (not shown). The negative rake angle in face 22 of the blade 20 may be between 0 degrees and 15 degrees. The preferred rake angle is between 5 and 10 degrees. In each of the negative rake angle grooves 24 is positioned a plurality of diamond cutters 26 equidistantly spaced along radially disposed groove 24.

The diamond discs 26 comprise, for example, a tungsten carbide substrate 33 with a polycrystalline diamond layer 35 sintered to a face of the substrate.

The polycrystalline diamond compact (PCD) is, for example, manufactured by Megadiamond, a division of Smith International of Provo, Utah.

Figure 4:
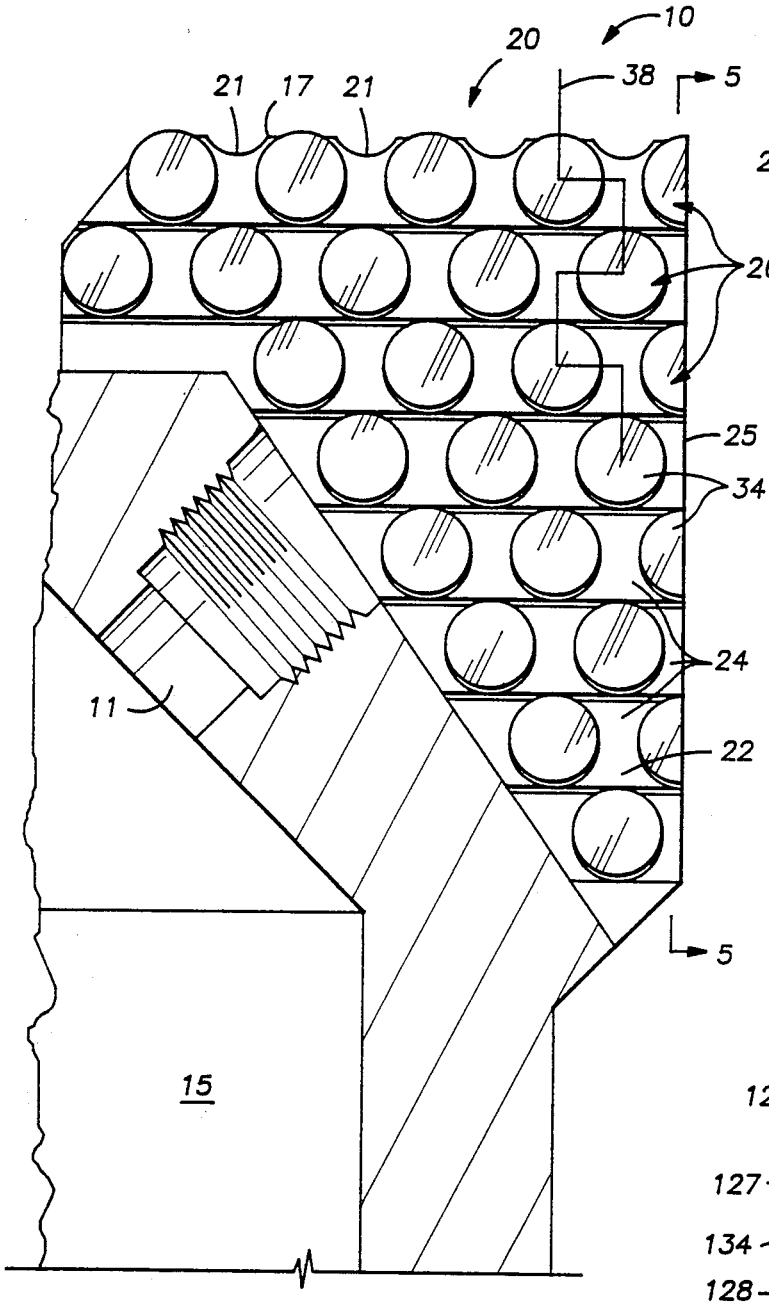
FIG. 4 is a partially broken away cross-sectional enlargement of the cutting face as shown in FIG. 2.

With reference to FIG. 4, each of the PCD cutters 26 in the radially disposed rows 24 is staggered (staggered line 38) from a preceding row. The longitudinally staggered PCD discs 26 destroys kerfs 19 which remain in the formation 37 from preceding eroded cutter rows as a bit 10 works in a borehole (see FIG. 2A).

Figure 2A:
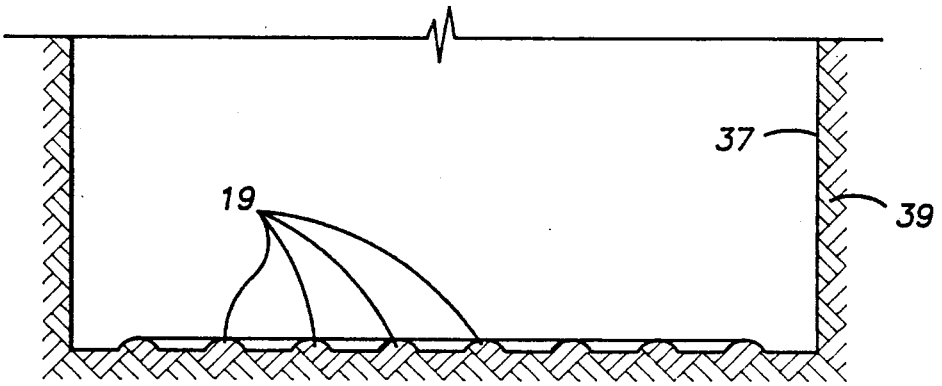
FIG. 2A is a cross-section of a borehole in an earthen formation.
Figure 2:
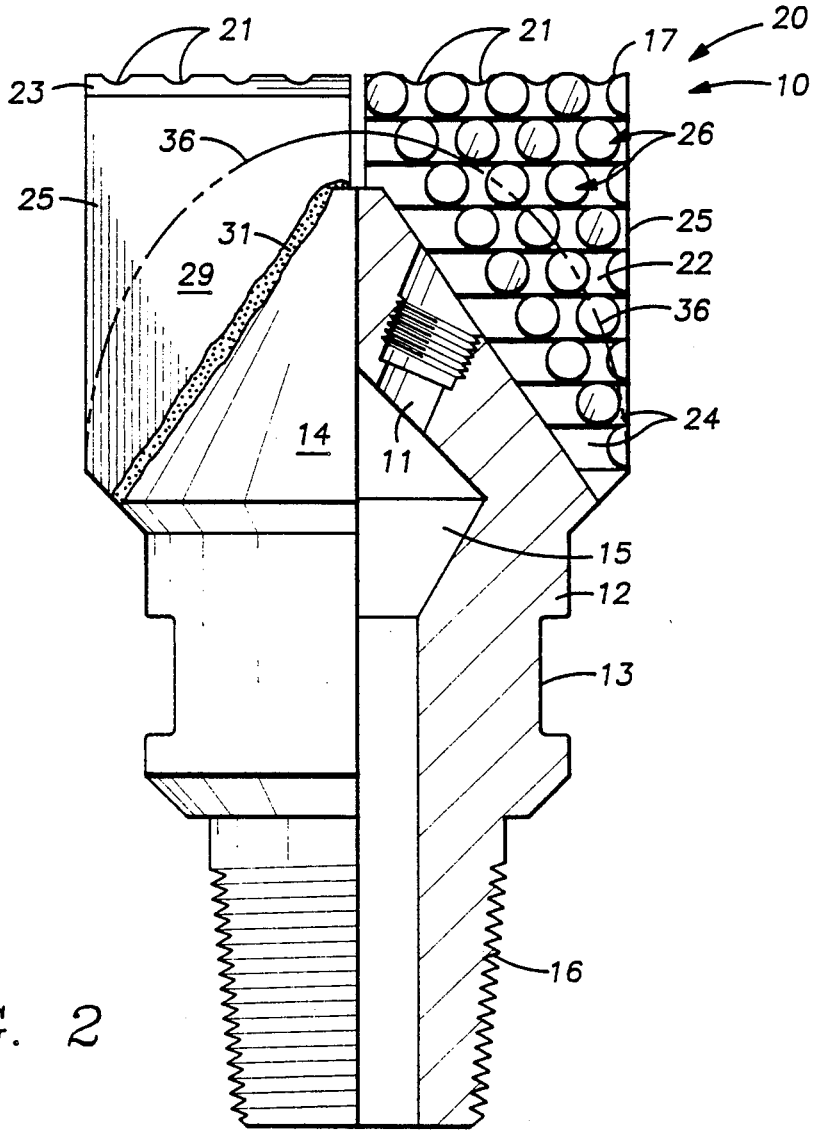
FIG. 2 is a partial cross-section of a fishtail bit illustrating a partially exposed plenum chamber for drilling fluid that is directed out of one or more nozzles; a cutting face of one of the blades shows radial rows of equidistantly spaced cutters that are longitudinally staggered one from the other, in adjacent rows.

Referring now to FIG. 2, the partially sectioned bit 10 illustrates the blade 20 with the radially oriented rows of diamond 26 in each of the negative rake angle rows 24. A series of grooves 21 are formed in the end of each of the blades 20 the grooves 21 being oriented substantially perpendicular to the face 22 of the blade 20. The grooves 21 serve to form kerfs 19 in the formation during operation of the bit 10 in a borehole 37 (see FIG. 2A). Since the material of the blade 20 is softer than the PCD cutters 26 the groove 21 tends to erode faster than the wear of each of the PCD cutters hence the groove 21 is naturally formed between the cutters as the bit wears down during operation of the bit in a borehole 37.

Moreover, as the bit wears it serves to form a parabolic curve such as that shown in phantom line 36. The somewhat triangular shape of the blades 20 is designed to accommodate this wear pattern. The blades serve to provide new diamond cutters 26 as the bit parabolically forms during wear of the bit in the borehole 37. This configuration serves to provide new diamond as the bit wears thus maintaining a relatively uniform penetration rate of the bit as it drills in a borehole.

Figure 3:
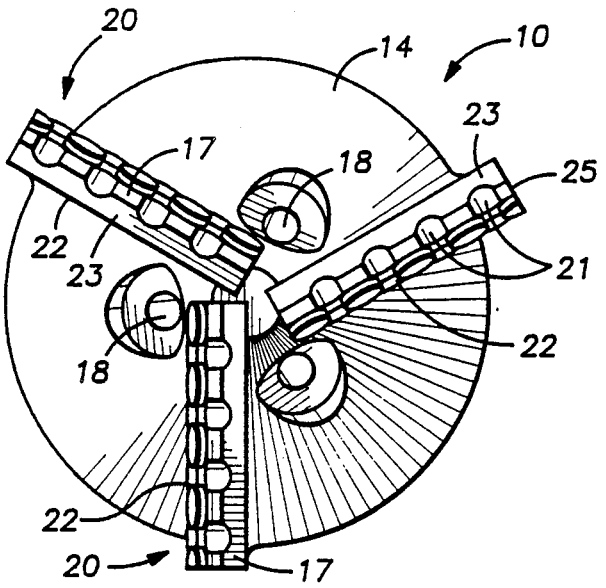
FIG. 3 is an end view of the bit shown in FIG. 1.

FIG. 2 depicts interior chamber 15 formed in bit body 12 which directs fluid from pin end 16 through conduit 11 and out through nozzle 18 (not shown in FIG. 2). The nozzle 18 is shown in FIGS. 1 and 3.

With reference now to FIG. 2A, each radially disposed row of PCD cutters 26 create a kerf 19 in the formation 39 as the bit is rotated in a borehole 33. A ridged rock formation kerf 19 is easier to break in shear once it is formed by the PCD cutters. An adjacent row of radially aligned PCD cutters is staggered from a preceding row so that the edged kerf 19 may be removed. Not only is the formation removed more efficiently, the fishtail bit is continuously sharp throughout the life of the bit. The PCD cutters 26 being arranged on each blade 20 to provide maximum cutting action as the bit parabolically wears during use.

The grooves 21 formed at the cutting end of each radially disposed blade shifts from one row to an adjacent row because of the staggered position of the PCD cutters 26. A new kerf is removed by the next row of PCD cutters mounted on each blade of the bit 10.

Drilling fluid exiting the nozzles 11 assure that cuttings or detritus is removed from the borehole while also serving to cool and clean the PCD cutters mounted to the cutting face 22 of the blade 20.

With reference now to FIG. 3, the view shows the cutting end 17 of each of the blades 20. Each of the blades 20 are oriented substantially at 120 degrees, one from the other, at the cutting end of the bit body 12.

A chamfered surface 23 is formed behind the leading edge of the cutting end 1 of the blades 20 to provide a relieved heel surface behind the PCD cutters 26 thus minimizing drag and enhancing the penetration rate of the fishtail bit 10 as it works in a borehole. Chamfer 23 is provided at end 17 behind the blade leading edge or face 22 to account for a rebound of the formation that occurs behind the cutter blades as the bit is rotated in the borehole. The rebounding formation creates drag behind the PCD cutters and the chamfered surface provides clearance for this phenomenon. As the bit wears down, the rebounding formation will continually maintain this clearance since the blade material will erode at a faster rate than the diamond cutters 26.

The nozzles 18 in each 120 degree segment of the bit body 12 provide drilling fluid under pressure to remove debris from the borehole bottom and to cool and clean each of the cutters as the bit works in the borehole.

Figure 5:
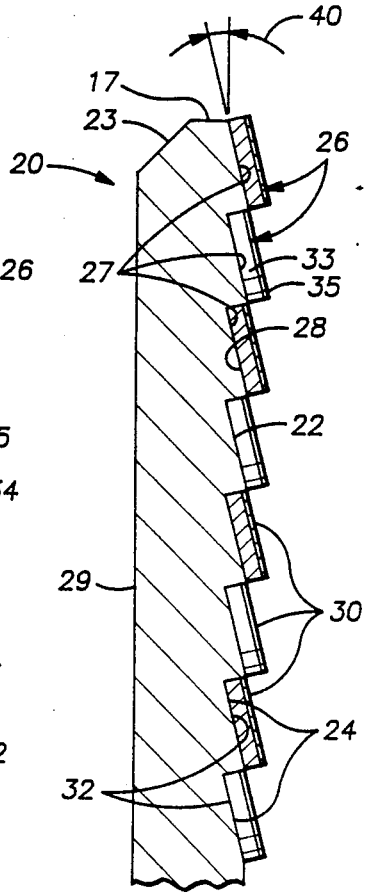
FIG. 5 is a cross-section of a blade taken through 5—5 of FIG. 4.

FIG. 4 depicts an enlarged partially cut away section of one blade 20 of the bit 10. Each of the diamond cutter discs 26 are metallurgically bonded within, for example, a circular recess 27 formed in cutting face 22 of the blades 20. Referring to both FIGS. 4 and 5 the section in FIG. 5 shows the diamond cutters 26 bonded at base 28 of the stud 33 within the recess groove 27 in groove 24. Each of the equidistantly spaced diamond cutters are preferably brazed within circular recesses formed in the grooves 24 of the face 22. As heretofore stated each of the equidistantly spaced cutters along the negative rake angle groove 24 are secured within their own recess 27. Each preceding row being staggered to facilitate removal of any kerfs 19 formed by a preceding row thus eliminating kerfs formed on the borehole bottom of the formation 37.

Each of the blades are secured to dome 14 along weld 31 as illustrated in FIGS. 1 and 2. It would be obvious to form a fishtail bit with two blades 180 degrees apart as well as a drag bit with multiple blades equidistantly spaced around the circumference of the dome 14 without departing from the scope of this invention.

Figure 6:
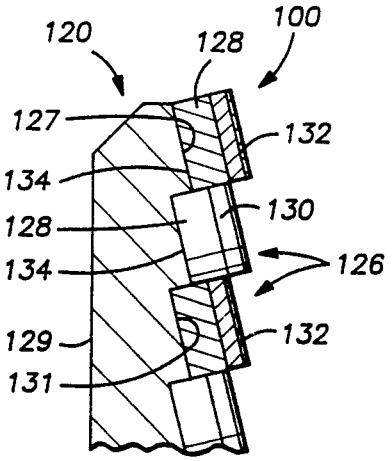
FIG. 6 is a partially broken away cross-section of an alternative embodiment of the invention.

In addition it would be equally obvious to provide diamond cutters with studs as shown in FIG. 6. The bit generally designated as 100 may have a blade 120 with radially disposed negative rake angle grooves 131 formed in face 125 of the blade 120. A series of equidistantly spaced insert holes 127 may be formed along the radially disposed grooves 131.

Each of the diamond discs generally designated as 126 may be a diamond disc which is bonded to a tungsten carbide stud body 128. The stud body is then, for example, brazed within diamond disc holes formed along the rake angle groove 131.

It will of course be realized that various modifications can be made in the design and operation of the present invention without departing from the spirit thereof. Thus while the principal preferred construction and mode of operation of the invention have been explained in what is now considered to represent its best embodiments which have been illustrated and described, it should be understood that within the scope of the appended claims the invention may be practiced otherwise than as specifically illustrated and described.

What is claimed is:

1. A drag type drill bit for drilling subterranean formation comprising:

a bit body forming a first pin end and a second cutting end, said pin end being adapted to be attached to a drill string, said body further forms an interior cavity in fluid communication with a supply of fluid contained within said drill string, at least one blade is attached to said bit body at said cutting end, said blade forms a leading edge configured to contact a bottom of said formation, each blade further forms on its forward cutting surface, a plurality of equidistantly spaced, radially disposed grooves formed therein, each groove is formed with substantially identical negative rake angles, with respect to said bottom of said subterranean formation, a multiplicity of diamond cutter discs are attached to and equidistantly spaced in each of the radially disposed grooves, one or more conduits formed by said body in fluid communication with the interior cavity of the bit, said conduits direct fluid toward said cutting end, and a multiplicity of grooves is further formed in said leading edge of said blade between said diamond cutter discs, the grooves being oriented substantially perpendicular to said forward cutting surface of said blade, the grooves being oriented substantially perpendicular to said forward cutting surface of said blade, the grooves between cutters provide a means to form a plurality of kerfs in said formation, said grooves further provide a means to pass said fluid through said grooves to remove detritus and to clean and cool each of said diamond cutters.

2. The invention as set forth in claim 1, wherein, the equidistantly spaced diamond disc in each of the radially disposed grooves are longitudinally staggered so as to eliminate said kerfs remaining in the formation from preceding, radially aligned eroded rows as the bit works in the borehole.

3. The invention as set forth in claim 1, wherein, said drag type drill bit is a fishtail bit having three blades attached to said body, each blade being substantially 120 degrees apart.

4. The invention as set forth in claim 3, wherein, said blades of said fishtail bit extend longitudinally substantially parallel with an axis of said bit body.

5. The invention as set forth in claim 1, wherein, there are fluid nozzles positioned in each of said one or more conduits formed by said body.

6. The invention as set forth in claim 1, wherein, said blade forming each radially disposed groove forms recesses that conform to a base of each of said cutter discs, said base being attached within said recess.

7. The invention as set forth in claim 6, wherein, each of said multiplicity of diamond cutter discs are metallurgically bonded in each recess formed in each of the radially disposed grooves.

8. The invention as set forth in claim 7, wherein, the metallurgical bond of the disc in each of the radially disposed grooves is formed from a braze material.

9. The invention as set forth in claim 8, wherein, the diamond cutter discs are polycrystalline diamond.

10. The invention as set forth in claim 1, wherein, the radially disposed grooves formed in said blade have a negative rake angle between 0 degrees and 15 degrees.

11. The invention as set forth in claim 10, wherein, the negative rake angle is between 5 and 10 degrees.

12. A drag type fishtail drill bit for drilling subterranean formations comprising:

a bit body forming a first pin end and a second cutting end, said pin end being adapted to be attached to a drillstring, said body further forms an interior cavity in fluid communication with a supply of fluid contained within said drillstring, three cutter blades positioned substantially 120 degrees apart are attached to said bit body at said second cutting end, each of said blades forming a leading edge configured to contact a bottom of said formation, each blade further forms, on its forward cutting surface, a plurality of equidistantly spaced radially disposed grooves formed therein, each groove is formed with substantially identical negative rake angles between 5 and 10 degrees with respect to a bottom of said subterranean formation, a multiplicity of diamond cutter discs are metallurgically bonded to and equidistantly spaced in each of the radially disposed grooves, said blade forming said grooves further forms recesses that conform to a base of said diamond cutter discs, the equidistantly spaced diamond disc in each of the radially disposed grooves are additionally longitudinally staggered so as to eliminate kerfs remaining in the formation from preceding, radially aligned eroded rows as the bit works in the borehole, one or more conduits formed in said body is in fluid communication with the interior cavity of the bit, each conduit having a nozzle secured within an exit end of the conduit to direct fluid from the interior cavity of the bit to the outside of the bit, and a multiplicity of grooves is formed in said leading edge of each of said blades, said grooves are formed between said diamond cutter discs, the grooves being oriented substantially perpendicular to said forward cutting surface of said blade, the grooves between cutters provide a means to form a plurality of said kerfs in said formation, said grooves further provide a means to pass said fluid through said grooves to remove detritus and to clean and cool each of said diamond cutters.

13. The invention as set forth in claim 12, wherein, a chamfer is formed behind said leading edge of each of said blades, said chamfer provides clearance for a rebounding formation thereby reducing drag and enhancing the penetration rate of the bit during operation of the bit in a borehole.

* * * * *